US007509950B2

(12) United States Patent
Dieterle et al.

(10) Patent No.: US 7,509,950 B2
(45) Date of Patent: Mar. 31, 2009

(54) SYSTEM FOR VENTILATION OF AN INTERNAL-COMBUSTION ENGINE CRANKCASE AS WELL AS A V-SHAPED INTERNAL COMBUSTION ENGINE

(75) Inventors: Frank Dieterle, Ditzingen (DE); Norman Woeckel, Weissach (DE)

(73) Assignee: Dr. Ing. H.C.F. Porsche Aktiengesellschaft, Stuttgart (DE)

( * ) Notice: Subject to any disclaimer, the term of this patent is extended or adjusted under 35 U.S.C. 154(b) by 178 days.

(21) Appl. No.: 11/352,255

(22) Filed: Feb. 13, 2006

(65) Prior Publication Data

US 2006/0180131 A1 Aug. 17, 2006

(30) Foreign Application Priority Data

Feb. 12, 2005 (DE) ..... 10 2005 006 438

(51) Int. Cl.
*F01M 13/04* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 4,541,399 | A * | 9/1985 | Tanaka et al. | 123/573 |
| 4,607,604 | A * | 8/1986 | Kanoh et al. | 123/572 |
| 5,005,553 | A * | 4/1991 | Washizu et al. | 123/572 |
| 5,024,203 | A * | 6/1991 | Hill | 123/573 |
| 5,069,192 | A * | 12/1991 | Matsumoto et al. | 123/572 |
| 6,725,849 | B2 * | 4/2004 | Stegmaier et al. | 123/572 |
| 6,920,869 | B2 * | 7/2005 | Murata et al. | 123/572 |
| 2002/0117158 | A1 * | 8/2002 | Burgess | 123/572 |
| 2003/0024512 | A1 * | 2/2003 | Kitano et al. | 123/572 |

FOREIGN PATENT DOCUMENTS

| | | |
|---|---|---|
| DE | 10127819 A1 | 1/2003 |
| DE | 102 35 983 A1 | 3/2003 |
| JP | 8-158853 | 6/1996 |
| JP | 2004-211644 | 7/2004 |

OTHER PUBLICATIONS

Engish Translation of German Office Action dated Oct. 5, 2005.

* cited by examiner

*Primary Examiner*—M. McMahon
(74) *Attorney, Agent, or Firm*—RatnerPrestia

(57) ABSTRACT

A ventilation system of an internal-combustion engine crankcase, in which the blow-by gases can be removed by bores integrated in the cylinder head and ventilation pipes connected thereto. The ventilation pipes are connected to a vacuum source such as a suction pipe, and devices pre-separate oil from the blow-by gases. At least one separate oil separation module is provided, whose oil separation chambers therein have first openings for the introduction of the blow-by gases and second openings for the return of the separated oil into the cylinder head.

9 Claims, 6 Drawing Sheets

SYSTEM FOR VENTILATION OF AN INTERNAL-COMBUSTION ENGINE CRANKCASE AS WELL AS A V-SHAPED INTERNAL COMBUSTION ENGINE

This application claims the priority of DE 10 2005 006 438.8, filed Feb. 12, 2005, the disclosure of which is expressly incorporated by reference herein.

BACKGROUND AND SUMMARY OF THE INVENTION

The present invention relates to a system for ventilating an internal-combustion engine crankcase as well as to such an internal-combustion engine, particularly having a V-shaped arrangement of the cylinders.

DE 101 54 669 A1 discloses an internal-combustion engine with at least two cylinder bank rows, in which oil separation chambers are provided on the interior side of the cylinder head covers for the crankcase ventilation. The oil separation chambers are an integral component of the crankcase ventilation system.

An object of the present invention is to provide a still further improved crankcase ventilation system and the connected separation of oil from the blow-by gases in order to finally be able to return purified blow-by gases to the suction system of the internal-combustion engine.

This and other objects have been achieved by providing at least one separate oil separation module whose oil separation chambers constructed therein have first openings for the introduction of the blow-by gases and second openings for the return of the separated oil into the cylinder head and a V-shaped internal combustion engine on which the oil separation module is arranged between a cylinder head cover of a cylinder bank row and the air intake module.

As a result of the fact that now a separate component is provided for the oil separation from the blow-by gases, the functionality of the crankcase ventilation can be further improved. The oil separation chamber integrated in the component module can be constructed to have a larger volume. As a result, a longer ventilation path can be implemented for the blow-by gases, so that the efficiency of the oil separation is further improved.

The transfer of the blow-by gases from the cylinder head into the oil separation chamber takes place via openings which, relative to the longitudinal dimension of the oil separation chamber, are arranged essentially in the center, while second openings for the return of the separated lubricating oil into the cylinder head are provided at the two respective ends of the oil separation chamber. In an internal-combustion engine in which the longitudinal dimension of the oil separation chamber coincides with the vehicle longitudinal axis, it is thereby ensured that, also when the motor vehicle is driving uphill and downhill, despite the lubricating oil situated in the camshaft space, the crankcase ventilation, by way of the oil separation chamber, is not impaired and separated oil can be returned via the second openings.

Because the volume fraction of the blow-by gases entering into the oil separation chamber is greater than the fraction of the separated lubricating oil, the opening cross-section for the transfer of the blow-by gases into the oil separation chamber is larger than the opening cross-section for the separated lubricating oil.

So that the blow-by gases are forced to enter the oil separation chamber via the central opening provided in the oil separation chamber, the return flow openings provided for the lubricating oil are monitored in a simple manner by valves.

These valves open up a connection to the cylinder head or the camshaft space only when lubricating oil has collected in this area. The valve, which, for example, has a mushroom shape, as a result of gravitational force, then opens up the opening and thus the return flow to the camshaft space.

For the targeted guidance of the blow-by gases in the oil separation chamber, partitioning webs are provided to guide the blow-by gas in a labyrinth-type manner from the intake to the exhaust. This labyrinth-type guidance of the blow-by gases allows the space in the oil separation chamber to optimally utilized. The lengthening of the path for the blow-by gases from the intake to the exhaust connected therewith results in a further calming of the blow-by gases and thus to a better separation of the lubricating oil.

The component module for the oil separation has a trough-shaped basic body which is closed by a separate lid.

A space-saving arrangement for such an oil separation module, which is suitable for a multi-row internal-combustion engine with a V-shaped arrangement of the cylinders, is obtained when one component module respectively is arranged in each case between a cylinder head cover of an internal-combustion engine and an air intake module placed centrally in the interior of the two cylinder bank rows.

The two oil separation chambers integrated in the oil separation modules are mutually connected by means of a hose assembly.

On one of the two oil separation modules, a pressure regulator is fastened whose output leads by way of a connection line to the suction pipe of the internal-combustion engine. As a result, the vacuum existing in the suction pipe as a function of the load condition of the internal-combustion engine can be regulated to a constant vacuum value suitable for the crankcase ventilation.

An additional oil separator is connected in front of the pressure regulator. The oil separator, as viewed in the flow direction of the blow-by gases, connects to the oil separation chamber integrated in the second oil separation module and is combined with the pressure regulator to form a constructional unit.

Other objects, advantages and novel features of the present invention will become apparent from the following detailed description of the invention when considered in conjunction with the accompanying drawings.

DETAILED DESCRIPTION OF THE DRAWINGS

Figure 1:
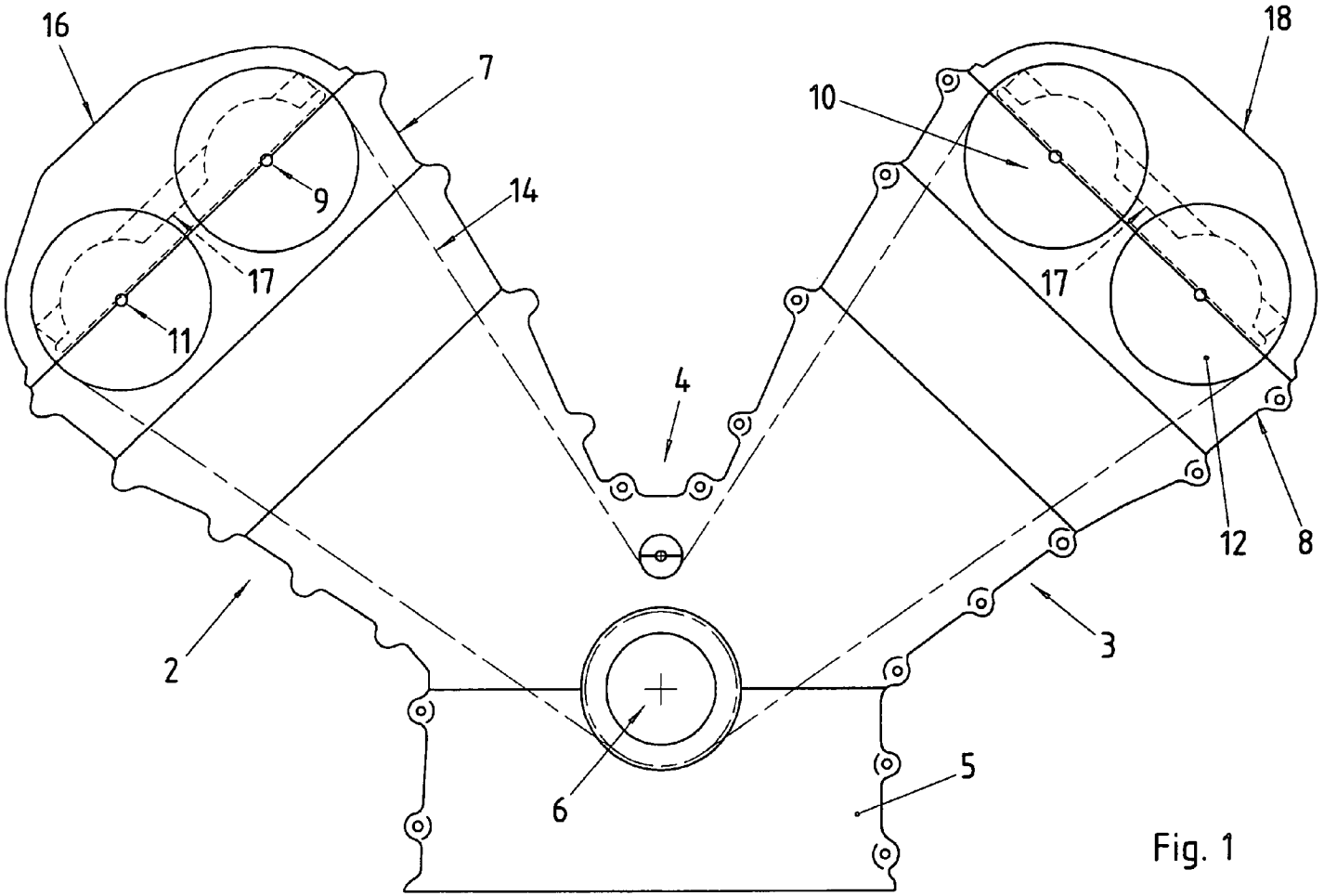
FIG. 1 is a front view of a V-shaped internal-combustion engine.

The internal-combustion engine constructed as a V8-engine has two cylinder bank rows 2, 3 which are both integrated in a crankcase top half 4 which is adjoined by crankcase bottom half 5 further developed as a crankshaft bearing bridge. Correspondingly, a crankshaft 6 is disposed between the crankcase top half 4 and the crankcase bottom half 5.

The two cylinder bank rows 2, 3 have two respective cylinder heads 7, 8 in which, among others, the intake camshafts 9, 10 as well as the exhaust camshafts 11, 12 are respectively accommodated and required for controlling the intake and exhaust valves respectively. The intake camshafts 9, 10 and the exhaust camshafts 11, 12 are driven by a driving double gear wheel arranged on the crankshaft 6 and a timing chain 14 (schematically shown by dashed lines) constructed as an endless chain.

Figure 2:
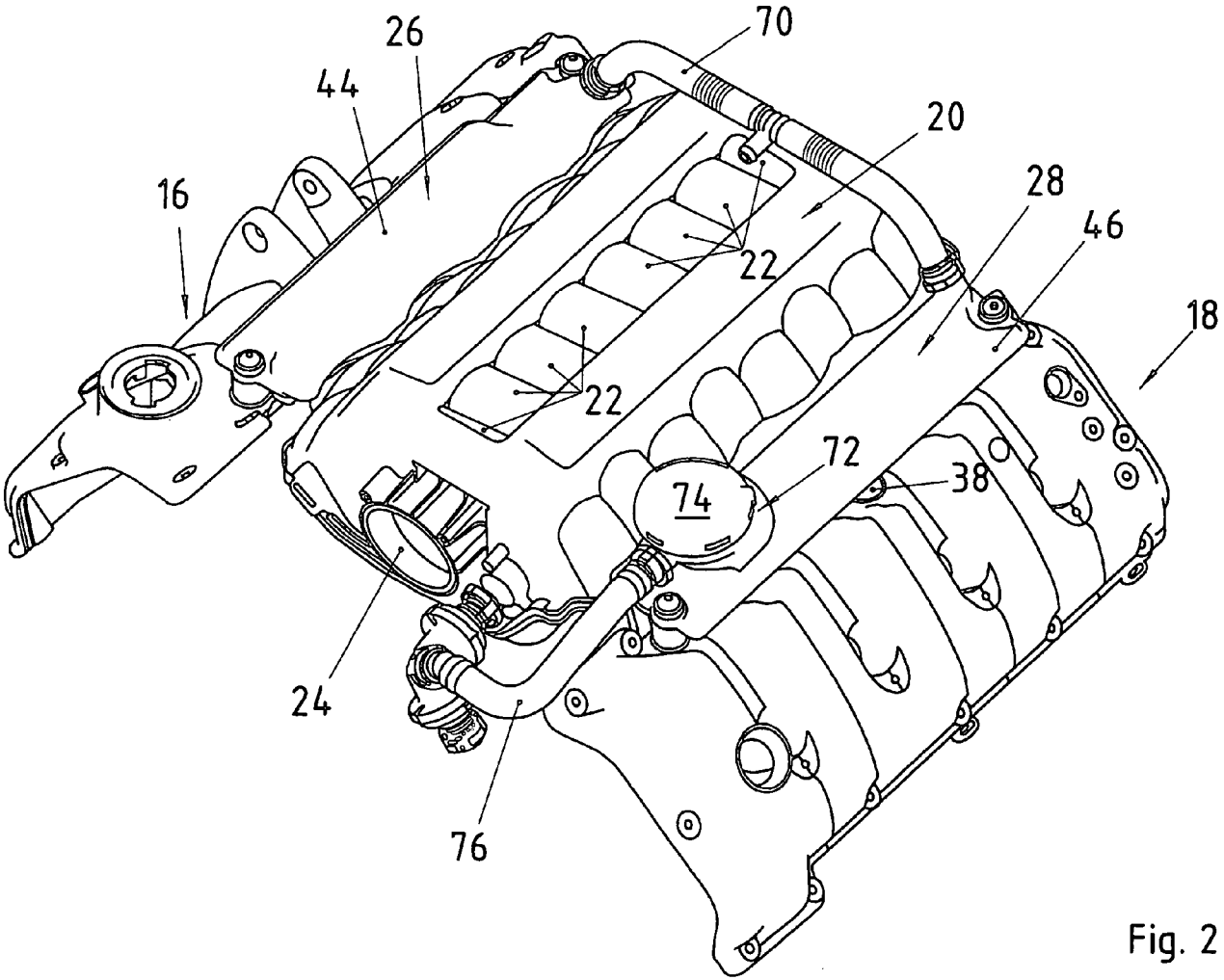
FIG. 2 is a perspective view of two cylinder head covers of the internal-combustion engine of FIG. 1 as well as of an air intake module arranged between the two cylinders.

Both cylinder heads 7, 8 are closed off toward the top by a cylinder head cover 16, 18 respectively. As illustrated in FIG. 2, in the interior between the two cylinder bank rows 2, 3, an air intake module 20 is arranged in which eight individual intake pipes 22 are constructed. By way of a central opening 24 constructed on the face side at the air intake module 20 and to which a suction pipe is connected, combustion air is fed by way of the individual intake pipes 22 to the individual cylinders.

Between the air intake module 20 and the two cylinder head covers 16, 18, one oil separation module 26, 28 respectively is arranged. The two oil separation modules 26, 28 are integrated in a crankcase ventilation system which, in a generally well known manner, is responsible for the guidance of the blow-by gases, which are transferred during the combustion or during the compression cycle into the crankcase space of the internal-combustion engine, to the outside thereof and back to the intake system of the internal-combustion engine respectively. Thus, the blow-by gases are caused to flow from the crankcase space into the camshaft space 17 of each cylinder head 7, 8.

For guiding the blow-by gases from the camshaft space 17 into the oil separation chamber 30, 31 constructed in the respective oil separation module 26, 28, one connection piece 36, 38 respectively is constructed on a trough-shaped basic body 32, 34. With respect to the longitudinal dimension of the oil separation module 26, 28, each connection piece 36, 38 is arranged essentially in the center and is fitted by way of two O-ring seals 40, 42 (FIG. 5) in a sealing manner into an opening in the cylinder head cover 16, 18. Both oil separation modules 26 and 28 consisting of a plastic material have a lid 44, 46 which bounds the oil separation chamber 30 in the upward direction and is fastened to the basic body 32, 34, for example, by friction welding method. By way of fastening screws 48 penetrating the lid 44, 46 and the basic body 32, 34, each oil separation module 26, 28 is screwed to the cylinder head cover 16, 18.

In the basic body 32, 34, one respective opening (hereinafter called air return flow openings 50, 52, 54, 56) are provided at both ends of the oil separation chamber 30, 31. These openings, sealed off by corresponding O-rings 58 (FIG. 6), correspond with openings (not shown) which are provided in the cylinder head cover 16, 18 and are connected with the camshaft space 17. In a first embodiment, the oil return flow openings 50, 52, 54, 56 are monitored by valves 60 constructed in a mushroom shape.

Figure 3:
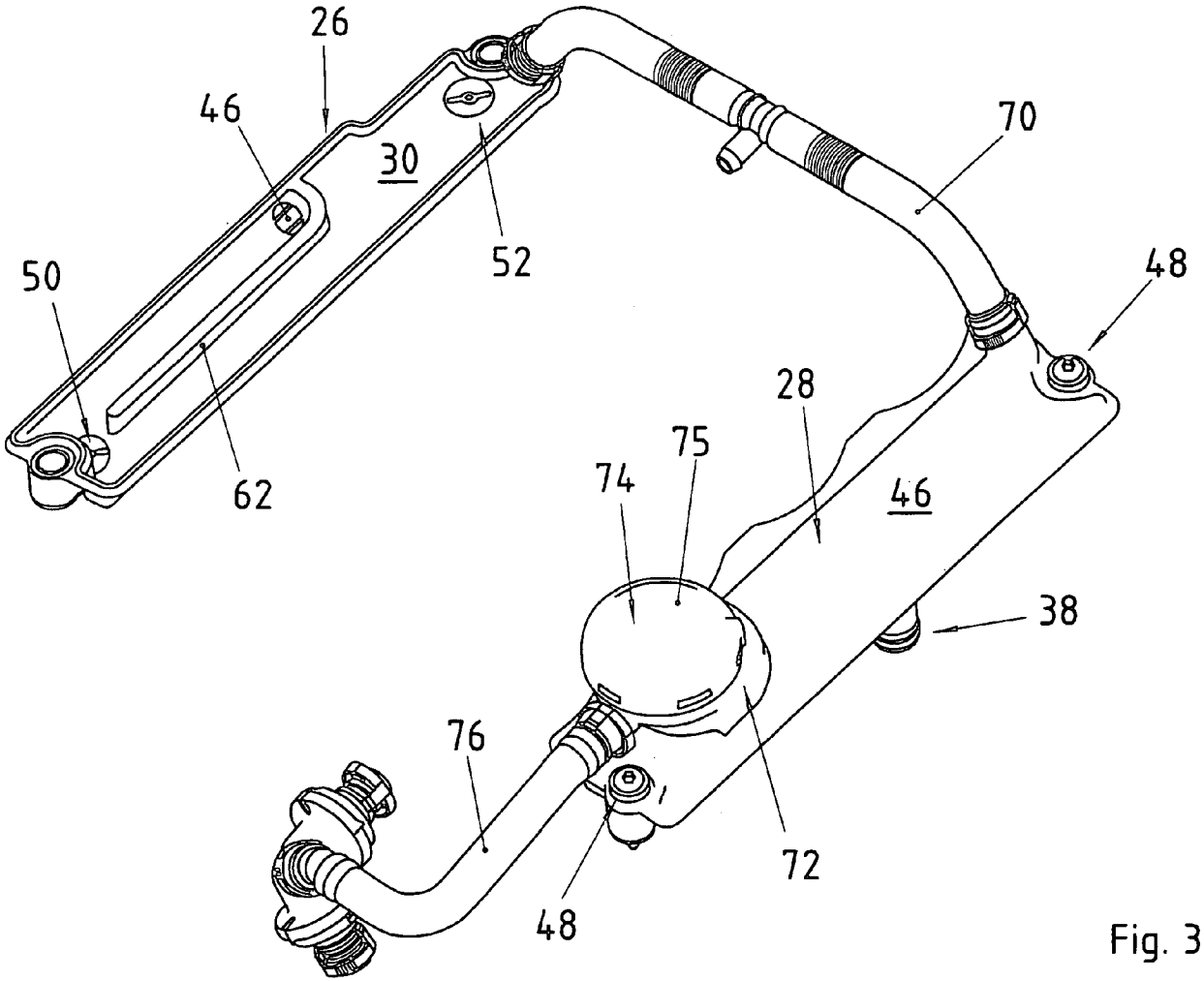
FIG. 3 is a top view of an oil separation system of the internal-combustion engine of FIG. 1.

FIG. 3 shows the oil separation module 26 without the lid 44, as seen in FIG. 2. A partitioning guide wall 62, 64, which shaped out of the basic body 32 and 34 respectively in one piece, is provided in the two oil separation chambers 30. The partitioning guide wall 62, 64 surrounds the respective intake opening 66, 68 (FIG. 4) and extends in the direction of the two oil return flow openings 50, 54 placed in the basic body 32, 34. The lid 44, 46 is fastened on the basic body, for example, by the friction welding method or the like. On the interior side of the lid 44, 46, a corresponding receiving groove for the partitioning guide wall 62, 64 is provided. At the end assigned to the two oil return flow pipes 52 and 56, the two oil separation chambers 30, 31 are connected with one another by a hose assembly 70.

Integrated in the basic body 34 of the oil separation module 28 is a funnel-shaped spiral oil separator 72 which is connected on its inlet side with the oil separation chamber 31 and, on its tapering end, has a discharge piece 73 (similar to the embodiment in FIG. 7) which is fitted into an opening of the cylinder head cover 18. A pressure regulator 74 is arranged on the spiral oil separator 72, and, as required, reduces the vacuum in the crankcase space with respect to the vacuum existing in the suction system. The pressure regulator 74 is closed off in the upward direction by a lid 75. A pipe 76 is connected to the pressure regulator 74 and leads to a suction pipe (not shown) of the air intake module 20.

The ventilation path for the blow-by gases will now be described after these gases had been transferred from the crankcase space into the camshaft space 17. As a result of the vacuum conditions existing in the suction pipe, the blow-by gases of the left and right cylinder bank row 2, 3 are guided by way of the connection pieces 36, 38 into the oil separation chambers 30, 31. A portion of the lubricating oil carried along by the blow-by gases can be separated in the oil separation chambers 30, 31 which, in turn, particularly in vehicle transient operation (accelerating, braking), returns by way of the oil return flow openings 50, 52, 54, 56 into the camshaft spaces 17. Thereby, the openings 50, 52, 54, 56 are opened up only when the valves 60 are opened up because of the gravitational force of lubricating oil drops, which have collected in this area. Blow-by gases from the camshaft space 17 are prevented from arriving in an uncontrolled manner by way of the oil return flow openings 50, 52, 54, 56 in the oil separation chambers 30, 31.

The blow-by gases in the oil separation chamber 30 are guided by the partitioning guide wall 62 first in the direction of the oil return flow opening in order to there, in a diverted manner, flow through the entire length of the oil separation chamber 30 and, by way of the hose assembly 70, arrive in the oil separation chamber 31. In the oil separation chamber 31, the blow-by gases introduced by way of the connection piece 38 are analogously to the oil separation chamber 30 guided by the partitioning guide wall 62, and, together with the blow-by gases transferred from the oil separation chamber 30, are guided to the spiral oil separator 72. If necessary, another purification of the blow-by gases takes place there, before, the blow-by gases are returned, by way of the pressure regulator 74 as well as by way of the pipe 76, into the intake line of the internal-combustion engine.

Figures 4, 5, 6:
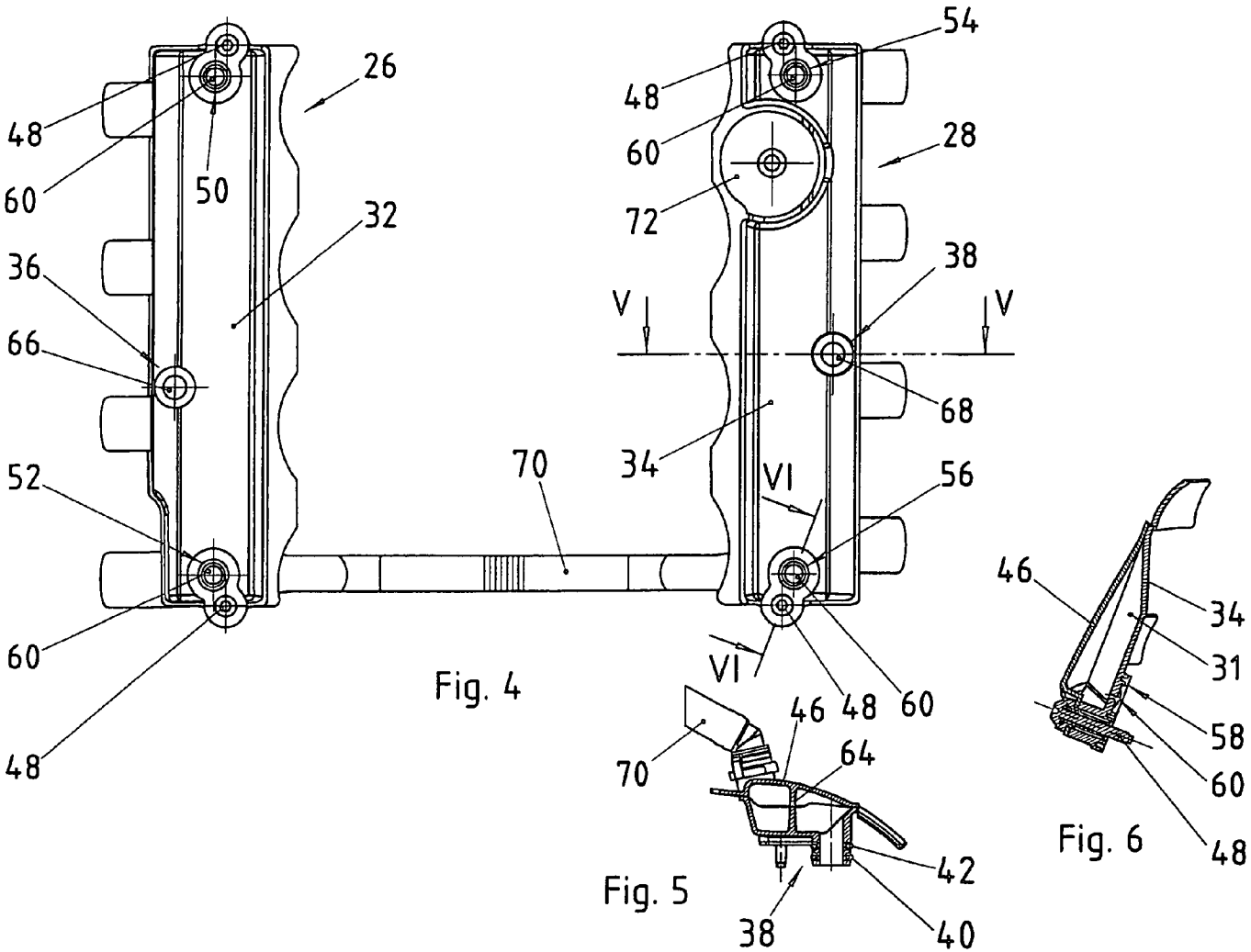
FIG. 4 is a bottom plan view of the oil separation system of FIG. 3.
FIG. 5 is a sectional view along line V-V in FIG. 4.
FIG. 6 is a sectional view along line VI-VI in FIG. 4.
Figure 7:
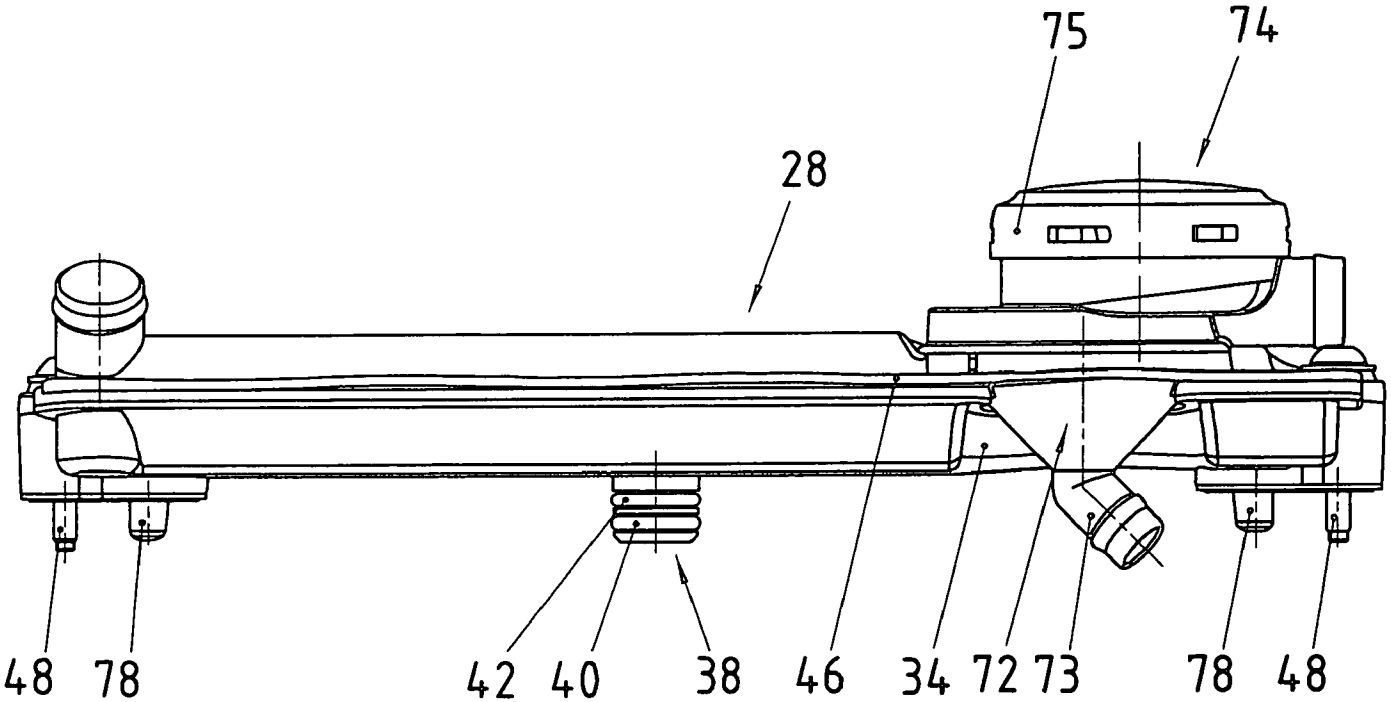
FIG. 7 is a side view of a second embodiment of an oil separation module.
Figure 8:
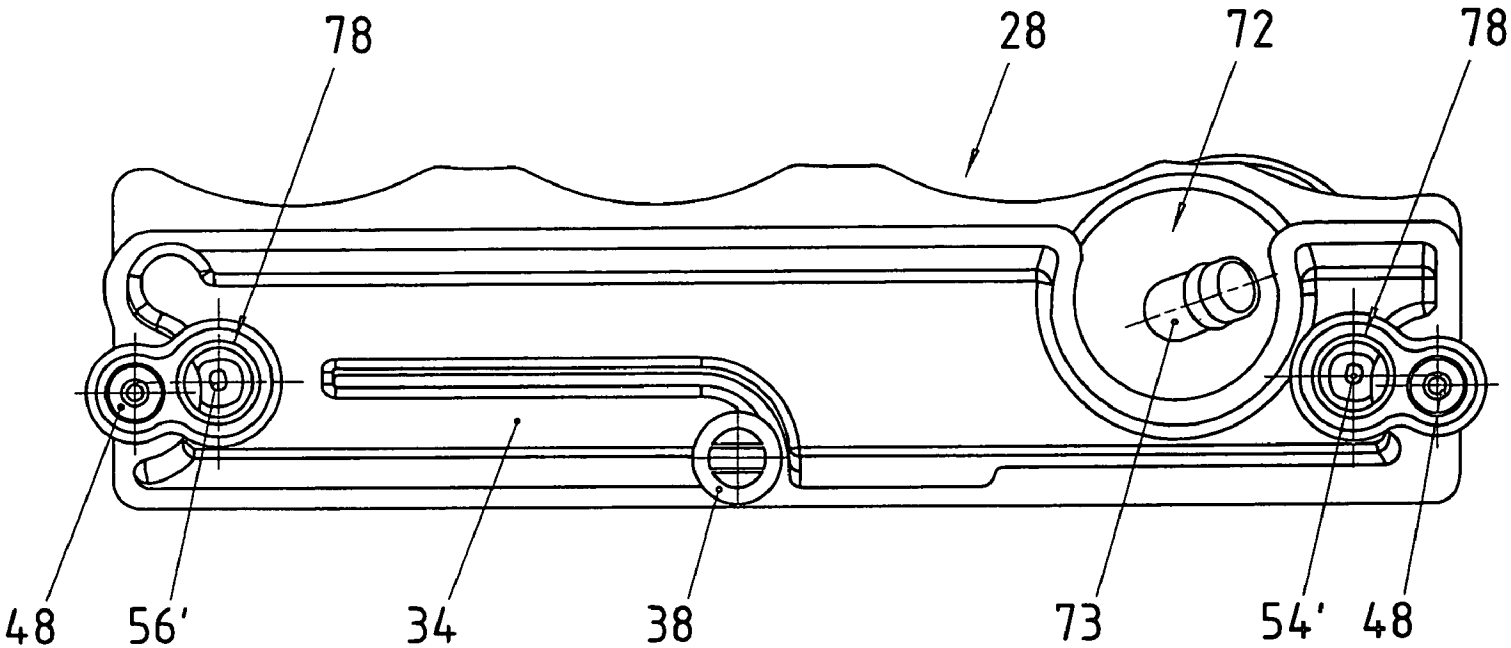
FIG. 8 is a view of the oil separation module of FIG. 7.

The valves 60 illustrated in FIG. 6, which monitor the oil return flow or the oil return flow openings 50, 52, 54 56, can also be eliminated, as illustrated in the second embodiment shown in FIGS. 7 and 8. For this purpose, discharge connection pieces 78 are molded to the basic body 32, 34 of the two oil separation modules 26, 28. At the face-side ends of the discharge connection pieces 78, oil return flow openings 50', 52', 54', 56' (only 54', 56' are shown) are arranged and preferably have a slot-type construction. In this case, the openings 50', 52', 54', 56' are dimensioned such that, because of the adhesion forces acting between the oil drops and the edges of the openings 50', 52', 54', 56', it is ensured that the openings 50', 52', 54', 56' are always closed by dripping-off oil, so that no blow-by gases can be transferred by way of these openings into the oil separation chamber 30, 31.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. System for ventilating an internal combustion engine crankcase, comprising bores integrated in a cylinder head cover and ventilation pipes connected thereto for removing blow-by gas, a vacuum source operatively connected to the ventilation pipes and at least one separation module is provided for pre-separation of oil from the blow-by gases, wherein the at least one module has an oil separation chamber constructed therein which has a first opening for the introduction of the blow-by gases and second openings for return of the separated oil into the cylinder head, relative to a longitudinal dimension of the oil separation chamber the first opening is arranged essentially centrally, and the second openings are provided at two respective ends of the oil separation chamber adjacent to respective ends of the cylinder head cover, and the at least one separation module is arranged on the engine crankcase such that the longitudinal dimension of the oil separation chamber is parallel to a longitudinal dimension of a vehicle in which the engine crankcase is mounted.

2. System according to claim 1, wherein a cross-section of the first opening is larger than a cross-section of the second openings.

3. System according to claim 1, wherein the second openings are operatively associated with and monitored by valve.

4. System according to claim 1, wherein the oil separation chamber is provided with partitioning guide wall for guiding the blow-by gases.

5. System according to claim 1, wherein the oil separation module has a trough-shaped basic body which is closed off by a separate lid.

6. System according to claim 1, wherein the internal combustion engine crankcase is a crankcase of a multi-row internal-combustion engine having a V-shaped cylinder arrangement and a centrally arranged air intake module between two cylinder bank rows, and the at least one separation module includes one separation module associated with a respective one of the two cylinder bank rows, and each separation module is arranged between a cylinder head cover of the respective cylinder bank row and the air intake module.

7. System according to claim 6, wherein a connection pipe is provided between the oil separation modules.

8. System according to claim 7, wherein a pressure regulator is operatively arranged on one of the oil separation modules and has an outlet leading to the internal-combustion engine air intake module.

9. System according to claim 8, wherein an additional oil separator is provided on one of the oil separation modules and is combined with the pressure regulator as a constructional unit.

* * * * *